US011664184B2

(12) United States Patent
Turner

(10) Patent No.: US 11,664,184 B2
(45) Date of Patent: May 30, 2023

(54) ELECTRON GUN DRIVER

(71) Applicant: Varex Imaging Corporation, Salt Lake City, UT (US)

(72) Inventor: John Turner, Las Vegas, NV (US)

(73) Assignee: Varex Imaging Corporation, Salt Lake City, UT (US)

( * ) Notice: Subject to any disclaimer, the term of this patent is extended or adjusted under 35 U.S.C. 154(b) by 0 days.

(21) Appl. No.: 16/925,304

(22) Filed: Jul. 9, 2020

(65) Prior Publication Data

US 2021/0012996 A1 Jan. 14, 2021

Related U.S. Application Data

(60) Provisional application No. 62/871,995, filed on Jul. 9, 2019.

(51) Int. Cl.

| | |
|---|---|
| ***H01J 29/96*** | (2006.01) |
| ***H05H 7/02*** | (2006.01) |
| ***H01J 25/60*** | (2006.01) |

(52) U.S. Cl.

CPC ..... *H01J 29/96* (2013.01); *H01J 25/60* (2013.01); *H05H 7/02* (2013.01)

(58) Field of Classification Search

None

See application file for complete search history.

(56) References Cited

U.S. PATENT DOCUMENTS 3,223,785 A * 12/1965 Drew ..... H04Q 3/545 379/279
3,535,444 A * 10/1970 Anderson ..... H04N 5/21 348/E5.077
4,584,079 A * 4/1986 Lee ..... C23C 14/34 257/776
4,802,080 A * 1/1989 Bossi ..... G06K 19/0701 363/90
5,403,989 A * 4/1995 Tobuse ..... H01J 9/50 348/E3.051
5,477,107 A * 12/1995 Tammaru ..... H01J 23/30 315/3.5

(Continued)

FOREIGN PATENT DOCUMENTS

WO WO-9700494 A1 * 1/1997 ..... G06T 7/246

OTHER PUBLICATIONS

PCT/EP2020/041470, International Search Report dated Oct. 2, 2020.

(Continued)

*Primary Examiner* — Srinivas Sathiraju
(74) *Attorney, Agent, or Firm* — Laurence & Phillips IP Law

(57) ABSTRACT

Technology is described for an electron gun driver including a half bridge driver circuit and a drive controller. The half bridge driver circuit includes a drive circuit configured to generate a grid drive voltage for a grid connection of an electron gun, and a cutoff circuit configured to generate a grid cutoff voltage for the grid connection of the electron gun, and a gate driver configured to switch between the grid drive voltage and the grid cutoff voltage. The drive controller is configured to generate a pulse input to the drive circuit and cutoff circuit and grid switching signals for the gate driver.

19 Claims, 5 Drawing Sheets

(56) References Cited

U.S. PATENT DOCUMENTS 5,990,016 A * 11/1999 Kim ..... H01L 21/67069 156/345.43
7,800,311 B2 * 9/2010 Chiba ..... H01J 1/13 315/276
7,869,561 B2 * 1/2011 Dafni ..... H05G 1/70 378/19
7,892,062 B2 * 2/2011 Skupien ..... H01J 9/18 445/44
7,893,620 B2 * 2/2011 Lewis ..... H01J 23/34 315/3
7,898,346 B2 * 3/2011 Kobayashi ..... H01J 23/34 330/45
7,952,288 B2 * 5/2011 Nakazato ..... H01J 23/34 315/5
8,212,481 B2 * 7/2012 Nakazato ..... H01J 25/34 330/45
8,294,367 B2 * 10/2012 Herring ..... H05B 41/14 315/1
8,647,585 B2 * 2/2014 Hancock ..... H05H 1/46 422/186.04
8,693,638 B2 * 4/2014 Dafni ..... H01J 35/153 378/124
8,803,453 B2 * 8/2014 Eaton ..... H05H 7/02 315/504
8,942,351 B2 * 1/2015 Cheung ..... H05H 9/048 378/65
9,119,281 B2 * 8/2015 Chen ..... H01J 35/025
9,661,734 B2 * 5/2017 Nighan, Jr. ..... H05H 7/02
9,831,883 B1 * 11/2017 Dropps ..... H03M 1/06
10,159,455 B2 * 12/2018 Takanaka ..... H05G 1/30
10,194,877 B2 * 2/2019 Bernhardt ..... H05G 1/34
10,367,508 B1 * 7/2019 Miller ..... H01J 35/025
10,420,201 B2 * 9/2019 Nighan, Jr. ..... H05H 7/02
10,443,139 B2 * 10/2019 Mills ..... C25B 1/04
10,601,432 B2 * 3/2020 Dropps ..... H03M 1/089
10,694,616 B2 * 6/2020 Liu ..... H05H 7/02
10,743,401 B2 * 8/2020 Abs ..... H05H 13/10
10,755,886 B2 * 8/2020 Richardson ..... H01J 23/04
2004/0262156 A1 * 12/2004 Seymour ..... H01J 37/3444 204/298.01
2006/0233297 A1 * 10/2006 Ishiyama ..... H01J 35/045 378/9
2011/0080992 A1 * 4/2011 Dafni ..... A61B 6/4014 378/9
2015/0165752 A1 * 6/2015 Plach ..... H01J 37/32339 216/36
2015/0303914 A1 * 10/2015 Ziemba ..... H03K 17/567 327/432
2016/0372304 A1 * 12/2016 Masnaghetti ..... H01J 37/244
2017/0265291 A1 * 9/2017 Nighan, Jr. ..... H05H 9/048
2018/0270941 A1 * 9/2018 Nighan, Jr. ..... G01V 5/0016
2018/0280733 A1 * 10/2018 Weidlich ..... A61B 6/50
2019/0154439 A1 * 5/2019 Binder ..... G01B 15/00
2020/0294401 A1 * 9/2020 Kerecsen ..... G05D 1/0287
2021/0012996 A1 * 1/2021 Turner ..... H01J 25/60

OTHER PUBLICATIONS

PCT/EP2020/041470, Written Opinion dated Oct. 2, 2020.
PCT/EP2020/041470, International Preliminary Report on Patentability dated Jan. 11, 2022.

* cited by examiner

ELECTRON GUN DRIVER

BACKGROUND

Unless otherwise indicated herein, the approaches described in this section are not prior art to the claims in this disclosure and are not admitted to be prior art by inclusion in this section.

Linear accelerators (i.e., linacs) are used in systems, such as sophisticated medical, security inspection, communication, and radar systems. The linear accelerator may be used as part of a system that generates x-rays or amplifies a radio frequency (RF) or microwave electromagnetic signal. Some linear accelerators generate pulses of accelerated particles by pulsing power supplied to a particle source (e.g., an electron gun) and power to an RF source (e.g., a magnetron). Some linear accelerators have fixed voltage levels and timing for the power supplied to a particle source and power supplied to an RF source, fixing the energy and dose rate (e.g., the timing and amplitude) for the pulses. Other linear accelerators may switch between two or more factory-defined modes where each mode has an associated power supplied to the particle source and power supplied to the RF source. The timing of the supplied power is the same for each mode. Moreover, the mode is switched based on a predefined pattern, alternating between the two modes. The power and pulses provided to an electron particle source, also referred to as an electron gun (e.g., a diode gun or a triode gun) is conventionally provided by an electron gun driver, also referred to as an electron gun modulator.

DETAILED DESCRIPTION OF SOME EXAMPLE EMBODIMENTS

Figure 1:
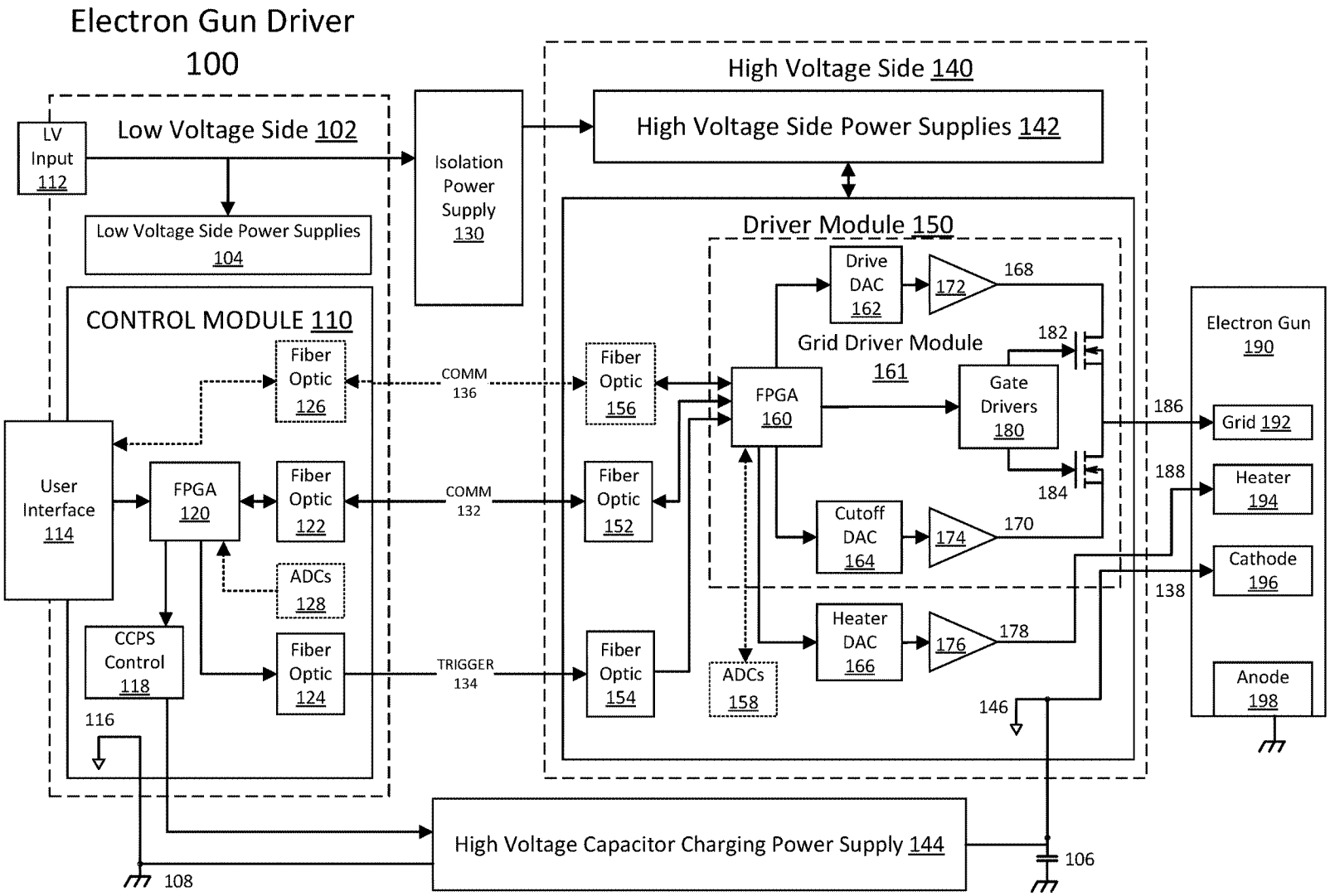
FIG. 1 illustrates a schematic or block diagram of a triode gun driver according to some embodiments.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Numbers provided in flow charts and processes are provided for clarity in illustrating steps and operations and do not necessarily indicate a particular order or sequence. Unless otherwise defined, the term "or" can refer to a choice of alternatives (e.g., a disjunctive operator, or an exclusive or) or a combination of the alternatives (e.g., a conjunctive operator, and/or, a logical or, or a Boolean Oreg.). DC refers to direct current while AC refers to alternating current.

This disclosure relates to triode electron gun drivers that can modulate the amplitude, width, and delay of pulses for an electron gun grid from one pulse to the next pulse with high switching speeds. Disclosed embodiments relate generally to mechanisms, methods, and systems to drive the grid of a triode gun with different pulse amplitudes, widths and delays from one pulse to the next pulse. Disclosed embodiments also relate generally to grid driver circuitry for an electron gun.

Linear accelerators typically use a particle source configured to generate a particle beam, such as an electron source. The particle beam is directed through an accelerator structure. The accelerator structure is a resonant structure that uses an input RF signal to accelerate the particles in the particle beam. The accelerated particle beam is generated by pulsing the particle source to generate a pulse of particles directed at the accelerator structure. The RF signal accelerates the particles to generate the accelerated particle beam. As will be described in further detail below, an electron particle source may be controlled by a gun driver. In addition, the gun driver may be configured to provide pulses with variable amplitudes, widths, and delays as will be described in further detail below Conventionally the particle source of the linear accelerator uses a hot cathode or thermionic cathode, which is a cathode electrode with a heating element or filament that is heated to emit electrons due to thermionic emission. The heating element is typically an electrical filament heated by an electric current passing through it. Two types of hot cathodes can be used in vacuum devices: A directly heated cathode and an indirectly heated cathode. In the directly heated cathode, the filament is the cathode and emits the electrons directly. In the indirectly heated cathode, the filament is not the cathode but rather heats a separate cathode, such as a sheet metal cylinder surrounding the filament, and the filament or cylinder emits electrons. Conventionally a linear accelerator uses indirectly heated cathodes.

For a linear accelerator to be useful in a material discrimination applications, such as cargo screening, the x-ray pulses need to have their pulse energy and dose per pulse accurately controlled from one pulse to the next pulse. To control the dose and energy per pulse in the linac, the amplitude, width and delay of pulses to the radio frequency (RF) source (e.g., a magnetron) and the electron gun (e.g., a diode gun or a triode gun) need to be modulated from pulse to pulse.

Two classes of electron guns can be used in linear accelerators: A diode electron gun and a triode electron gun (or gridded electron gun). A diode electron gun or diode gun has two separate electric potentials: the cathode and a focusing electrode, which are set to some negative voltage (typically on the order of tens of kilovolts (kV)) and the anode, which is held at or near ground. In some embodiments, the cathode connection can have two leads: the cathode lead and the heater lead (or filament lead). Sometimes the two separate electric potentials of the diode gun refer to the cathode potential and the heater potential. In a triode electron gun or triode gun, a control grid (or grid) is added just above the surface of the cathode. The grid is held at a third potential, typically within around 100 volts (V) of the cathode potential. While diode electron guns can be suitable for use in simple, low energy linacs and x-ray sources, most high energy linacs utilize a triode electron gun because a triode gun allows more control and flexibility over the energy and timing of a pulse through the use of the grid than a diode gun. The grid is an electrode between the cathode and anode in a vacuum enclosure that functions as a "gate" to control the current of electrons reaching the anode. A more negative voltage on the grid will repel the electrons back toward the cathode so fewer get through to the anode. A less negative, or positive, voltage on the grid will allow more electrons through, increasing the anode current (also referred to as beam current).

As will be described in further detail below, the gun driver may be configured to control the cathode, heater, and grid. As used herein, the heater may also be referred to as the filament or cathode filament that creates electron emission when heated up or hot. Conventionally, the gun driver does not control the focusing electrode and control of the focusing electrode is provided by other components or power supplies.

As three voltage potentials (e.g., cathode, heater, and grid) relative a reference (e.g., anode) are used in a triode gun, at least four inputs or controls can be considered when designing and operating a triode gun. First, the anode is referenced to chassis ground, or the body of the accelerator to which the gun is mounted, which acts as a ground connection. Second, the cathode needs to be raised to a high negative voltage with respect to anode. In an example, a maximum cathode voltage has a voltage from −12 kV to −15 kV. In another example, the cathode voltage has a voltage range from 0V to −18 kV. In an example, high voltage can refer to voltage magnitude in the range of a cathode voltage relative to the anode. For example, high voltage can refer to a voltage magnitude (either positive or negative) that is greater than 1 kV. Third, the heater is driven with a lower voltage amplitude relative to the cathode, which can be positive or negative. In an example, the heater has a voltage amplitude between 2V and 10V with respect to the cathode or a voltage amplitude from 4V to 7V with respect to the cathode. Fourth, the grid has voltage from −200V to 200V with respect to the cathode. For example, in some designs a grid can typically prevent the flow of beam current with grid voltage driven to between −50V and −70V (also referred to as a cutoff voltage) with respect to the cathode when the cathode is at high voltage, and the grid can typically allow flow of beam current with a grid voltage driven to between 50V and 100V (also referred to as a drive voltage) with respect to the cathode when the cathode is at high voltage. In other examples, the cutoff voltage may cutoff beam current with a voltage greater than −50V (or voltage amplitude less than −50V) or less than −70V (or voltage amplitude greater than −70V), and the grid can allow the full beam current with a voltage less than 50V or greater than 100V. In an example, a high voltage as it relates to grid voltages can have a magnitude greater than 50V.

For some applications, the grid needs to generate pulses at a programmed amplitude at a fast rate by switching from a cutoff voltage, to a drive voltage, and back to the cutoff voltage at a specified pulse width with fast rise and fall times as to avoid distortion of the pulse, which can reduce the efficiency of the system. In an example, the pulse widths may need to be between 0.5 microsecond (μS) and 5 μS at a rate of up to 500 pulses per second (pps) or preferably up to 2000 pulses per second. In other examples, the grid pulse widths and/or pulse rate may be different. In addition, the adjustability or programmability of the cathode voltage, heater voltage, grid drive voltage, grid cutoff voltage, grid pulse delay, and grid pulse width by a gun driver can give a user greater control of the energy and dose of the pulse, which can provide more functionality and applications for the electron gun or the system (e.g., linac).

Conventional gun drivers offer some adjustments of the amplitude, width and delay parameters, but typically on a very long timescale (on the order of seconds (s)) that makes them impractical for use in a material discrimination x-ray imaging system where grid adjustments need to happen on the millisecond (ms) or sub-millisecond level (μS), preferably modulated or adjusted on a pulse to pulse basis. For example, conventional gun drivers may have a grid drive voltage that can be modulated from pulse to pulse, but can only switch between two different voltages or modes, also referred to as interleave modes, as illustrated by U.S. Pat. No. 9,661,734 (referenced herein as "Nighan patent"), entitled "Linear Accelerator System with Stable Interleaved and Intermittent Pulsing, granted on May 23, 2017, which is incorporated by reference in its entirety. As disclosed in the Nighan patent, the driver for the grid uses voltages generated by the power supplies directly, and switches between these two fixed voltages, referred to as modes, on a pulse to pulse basis. The power supplies are typically only able to switch the voltage amplitudes at best within at least tens (10s) or hundreds (100s) of milliseconds (ms), which is insufficient for switching between more than two voltage amplitudes at a rate of at least 500 pulses per second. The limitation of the two voltage amplitudes of the dual mode gun driver at fast switching speeds (within the millisecond and sub-millisecond level) may be mitigated by adding power supplies for each additional mode and switching between the fixed voltages of those power supplies. But such an approach can add more design complexity and cost, especially as the number of different modes increases. In addition, the number of different modes that can be used is still limited by the number of power supplies used.

In other conventional gun driver examples (not shown or referenced), a gun driver may use a single power supply that switches between high voltage capacitor banks using a relatively expensive solid-state switch to drive the grid, where each capacitor bank is designed to generate a specific voltage amplitude or mode. Similarly, the gun driver using multiple high voltage capacitor banks to drive the grid has the limitation that the number of modes that can be used is limited by the number of high voltage capacitor banks used along with the associated design complexity and cost.

In contrast, the disclosed design allows for adjustment to both the grid drive voltage and grid cutoff voltage on the sub-millisecond level, making these two parameters (e.g., the grid drive voltage and grid cutoff voltage at some finite resolution within the gun driver's available dynamic range) available to the user on a pulse to pulse basis.

Conventionally, a system (e.g., linac) that can switch between two modes on a pulse to pulse basis is referred to as an interlaced system or an interleaved system, where each x-ray mode has a specified or defined dose and energy of the x-ray beam. Typically, dose is determined by the RF source pulse amplitude and width in combination with the electron gun pulse amplitude, width, and delay. Energy is primarily determined by the RF source pulse amplitude, where the electron gun pulse amplitude, width, and delay can also have an effect. For example, an interlaced linac can be configured to switch from pulse to pulse between an x-ray beam of dose A and energy A and another x-ray beam of dose B and energy B. A gun driver with interlaced capability allows the linac to select between two pulse modes from pulse to pulse. So, a first pulse mode is a pulse of amplitude A, width A and delay A, while the second pulse mode can be of amplitude B, width B and delay B.

By contrast, a system (e.g., linac) with interweave capability can select between more than just two modes (i.e., n modes where n is a positive integer) on a pulse to pulse basis. A gun driver with interweave capability can generate a pulse of any amplitude, width, and delay within its dynamic range (with some finite resolution) from pulse to pulse. A gun driver (along with a magnetron modulator or RF modulator) with interweave capability allows a system to operate as an interweaved system, which provides greater versatility and functionality for x-ray imaging, such as material discrimination, relative to the interlaced system or interleaved system.

In an embodiment, as illustrated in FIG. 1, a triode gun driver 100 is divided into at least two main sections: (1) a control side or a low voltage side 102 that may include a control board, a control circuit, or control module 110 (or control board 110 when formed as a single printed circuit board) and (2) a high voltage side 140, sometimes referred to as a hot deck side (as another reference to high voltage). The "low voltage side" 102 and the "high voltage side" 160 have reference to their voltage magnitude relative to the system ground (e.g., linac system ground). The low voltage side 102 is referenced to the same chassis ground (or linac system ground) 116 and signal grounds 108 that are used throughout the rest of the system, while the high voltage side 140 is referenced to the high voltage output 146 (e.g., a negative voltage) of the high voltage capacitor charging power supply, high voltage capacitor charging module, or capacitor charging power supply (CCPS) 144.

The CCPS charges a high voltage capacitor 106. The high voltage capacitor 106 is a storage capacitor that accumulates the charge used to provide the instantaneous current during the pulse that flows primarily from cathode to anode of the gun and partially from grid to anode while the grid is turned on. As the pulse width is typically much smaller than the time between pulses (e.g., pulse duty cycle, or the ratio of pulse 'on' time to pulse 'off' time, can be in the range of 0.0001 to 0.05), the high voltage capacitor 106 can be charged up between pulses slowly (relative to the pulse width), and then quickly discharged or partially discharged during the pulse. The high voltage capacitor 106 allows the system to use a much smaller high voltage power supply than would be required if the high voltage power supply for the cathode itself had to provide the peak current needed during the pulse instead of the trickle charge used to charge the high voltage capacitor 106.

Both the low voltage side 102 and the high voltage side 140 may use low voltage control circuitry, such as microcontrollers or field-programmable gate arrays (FPGA) 120, 160, and low voltage power supplies 104, 148, 147. Although the low voltage controller 120 may be referred to by the example of the FPGA 120. Similarly, the high voltage controller 160 may be referred to as the FPGA 160 On the high voltage side 140, the 'ground' or 'reference' for the low voltage control circuitry is the output of the CCPS 144 (or cathode voltage), as that control circuitry is configured to drive the heater 194 and the grid 192, which voltages are specified with respect to the cathode 196. As a result, the low voltage side 102 is isolated from the high voltage side 140, and referred to as two separate sections or sides. In some examples, a high voltage enclosure is used to isolate the high voltage side 140 components from the low voltage side 102 components. In other example, the high voltage side 140 components and the low voltage side 102 components can be in the same enclosure or housing, where at least some of the high voltage side 140 components use high voltage standoffs as separation and isolation from the low voltage side 102 components. An isolation power supply 130 provides power to the high voltage side 140 and provides voltage isolation between the low voltage side 102 and the high voltage side 140. In an example, the isolation power supply 130 can be a DC/DC converter. The isolation voltage rating of the power supply 130 should be greater than the voltage output of the CCPS 144 (usually by some factor). For example, a CCPS 144 that is configured to generate a cathode voltage up to −18 kV, the isolation power supply rating can be 30 kVDC.

The high voltage side 140 can include a driver module 150 that includes a grid driver module 161 and a heater driver 176 along with the communication circuitry 152, 154, 156 and conversion circuitry (e.g., analog to digital converters (ADCs) and digital to analog converters (DACs)) 158, 166. The grid driver module 161 can include circuits that provide interweave capability, which can be configured to generate a pulse of any amplitude, width, and delay within its dynamic range. For example, the grid driver module 161 can include a drive controller 160, a drive voltage amplifier 172, and a cutoff voltage amplifier 174, a gate driver 180, and switches 182, 184. The grid driver module 161 can be configured as a half bridge circuit, where the gate driver 180 rapidly controls switches 182, 184 to apply the voltage 168 of the drive voltage amplifier 172 or the voltage 170 of the cutoff voltage amplifier 174 to generate a pulse on a grid connection 186 of the grid 192. The drive voltage amplifier 172 can be powered by a drive amplifier power supply 143 and the cutoff voltage amplifier 174 can be powered by a cutoff amplifier power supply 145. The input for the drive voltage amplifier 172 can be configured by a drive DAC 162 and the input for cutoff voltage amplifier 174 can be configured by a cutoff DAC 164. The drive controller 160 can apply parameters from the user interface 114 to adjust the pulse amplitude pulse by pulse by inputs to the drive DAC 162 and cutoff DAC 164 and adjust the pulse width and delay via the gate drivers 180 and switches 182, 184.

One advantage of using high voltage power amplifiers 172 and 174, especially over direct connection (with switches) of the output of high voltage power supplies to the grid, is that the amplifier output can be changed or reconfigured rapidly pulse by pulse at a rate of up to 500 pulses per second. Some examples, the output of the high voltage power amplifiers 172 and 174 be changed or reconfigured pulse by pulse at a rate of up to 1000 pulses, 2000 pulses, 4000 pulses, or 8000 pulses per second. Some high voltage power amplifiers 172 and 174 can have a slew rate greater than of 25V/μS, providing fast amplifier output rise and fall times. As a result, the pulse amplitude can be varied per pulse allowing for configurable modes at a rate of up to 500 pulses per second.

The slow switching speeds (of the voltages) of the components of conventional gun drivers are limitations to performing grid switching functionality (analogous to functions to the grid driver module 161) with interweave capability in systems with usable pulse rates (e.g., greater than 500 pps). The use of high voltage power amplifiers 172 and 174 can shift the pulse rate limitation of the gun driver from the grid driver module 161 to the recharge speed of the high voltage capacitor 106. In some examples, the recharge speed of the high voltage capacitor 106 after having been discharged during the pulse is around 8000 pps. Thus, in some examples, the output of the high voltage power amplifiers 172, 174 be changed or reconfigured pulse by pulse at a rate of up to 8000 pulses per second.

The drive controller 160 may also provide apply parameters to change the inputs to the heater DAC 166, which can generate the input for the heater amplifier 176 resulting in a heater voltage 178. The heater amplifier 176 can be powered by a heater amplifier power supply 147.

Figure 2:
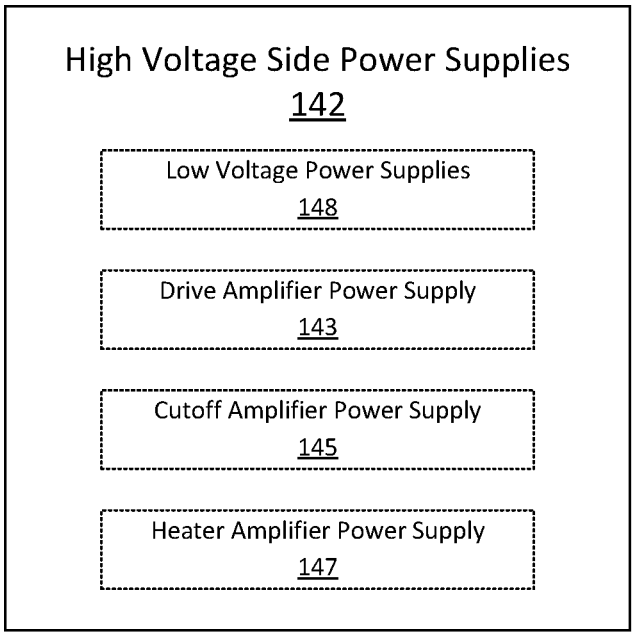
FIG. 2 illustrates a schematic or block diagram of high voltage side power supplies according to some embodiments.

As previously discussed, the high voltage side 140 can include one or more high voltage side power supplies 142. FIG. 2 illustrates some of the power supplies that can be included in the one or more high voltage side power supplies 142, such as one or more low voltage power supplies 148, a drive amplifier power supply 143, a cutoff power supply 145, and a heater amplifier power supply 147; however, in other embodiments, the number and type of power supplies may be different. In an example, the high voltage side power supplies 142 can generate voltages of 3.3V, +/−15V, −10V (e.g., a heater amplifier power supply 147), 24V and +/−200V (e.g., drive amplifier power supply 143 and cutoff amplifier power supply 145).

The following provide additional details on the function, connections, and interfaces of the triode gun driver 100. Referring back to FIG. 1, control functions and circuitry can be split between the low voltage side 102 and the high voltage side 140. For example, the control functions and circuitry may be split between the control module 100 and the driver module 150. In an example, the low voltage side controller 120 can be configured to: trigger the governing pulse rate and width (when in an external trigger mode); trigger a generator (when in internal trigger mode); monitor interlock signals to allow or inhibit certain gun driver functions, interface with the user interface 114 to process supervisory user data; interface with user human-machine interfaces (HMI) used for service; interface with other discrete user signals; control the CCPS; interfaces with high voltage side controller 160 via fiber optic communication link 122; interface with analog to digital converters (ADCs) 128; and interface with the digital to analog converters (DAC). The high voltage side controller 160 can be configured to: receive trigger signals from controller 120 and use the trigger signals to generate gate drive signals for switches 182, 184 in the half bridge; interface with the user interface, which contains pulse amplitude, width and delay parameters from the user to be applied to the next pulse; interface with the ADCs 158, which provide sensor or electrical readings or measurements of various components, such as the heater voltage and current, grid drive and cutoff amplifier voltages, gun current, and grid drive and cutoff power supply voltages; interface with DAC, which programs grid drive and cutoff amplifiers and heater supply; and turn the heater on and off.

The gun driver 100 may include functionality used in conventional gun drivers for backward compatibility with conventional gun drivers so that the disclosed gun driver may also be used as a replacement for a conventional gun driver as well as provide additional mode functionality. For example, some analog signals may be generated by the CCPS 144 (e.g., voltage and current monitor signals) or the user interface 114 (e.g., heater setting, cathode voltage setting, grid drive voltage setting, and grid cutoff voltage setting). The ADCs 128 may convert those analog signals to digital format for processing by the processor 120. The analog user signals may be used in scenarios where pulse to pulse interweaving is not used. The processor 120 can convert digital signals via DAC (not shown), which can be transmitted to the CCPS 144 or the user interface 114.

The low voltage side 102 uses a power input 112 and interfaces with the user (e.g., a linac control system) using the user interface 114, controls the CCPS using the CCPS control 118, and provides communications 122, trigger 124, and possibly additional signals to the high voltage side 140. In an example, the power input 112 can be configured to generate 15V or 24V DC. The low voltage side 102 includes a controller or processor, such as a microcontroller or a FPGA 120 and ADCs 128. The user interface 114 is coupled to the low voltage controller 120 and exchanges various communication signals such as trigger signals, interlocks signals, discrete input/output (I/O) signals, and safety signals and can use various communication protocols, such as Ethernet. Ethernet is a family of computer networking protocols commonly used in local area networks (LAN), metropolitan area networks (MAN) and wide area networks (WAN). The Internet Protocol (IP) is commonly carried over Ethernet and so it is considered one of the key technologies that make up the Internet. A trigger is the user trigger signal that is used to pulse the grid when in external trigger mode. Standby interlocks should be satisfied to allow the user to turn the heater on. Trigger interlocks should be satisfied to allow the grid to be triggered. High voltage interlocks should be satisfied to allow the user to turn on cathode high voltage. Discrete I/O signals allow a user to control certain functions of the gun driver that would otherwise be controlled via the low voltage side controller 120 (e.g., high voltage on, heater on, trigger enable/disable, and fault reset). Safety signals can allow a user to monitor certain statuses that would otherwise be monitored via the low voltage side controller 120 (e.g., interlock status, fault status, high voltage on status, trigger status, warmup status, and heater status). In addition, additional user analog outputs may be used so the user can optionally monitor the heater voltage, heater current, cathode voltage, and grid drive voltage. Although Ethernet was used as an example, in other embodiments, other communication protocols may be used.

Some fiber optic links between the low voltage side 102 and the high voltage side 140 provide a means of communication (e.g., fiber optic communication link 132, low voltage side or control fiber optic communication link [connector or interface] 122, and high voltage side fiber optic communication link [connector or interface] 152) between the two sides (i.e., low voltage side 102 and high voltage side 140) as well as the trigger signal (e.g., fiber optic trigger link 134, low voltage side or control fiber optic trigger link [connector or interface] 124 and high voltage side 140 fiber optic trigger link [connector or interface] 154) and optionally some additional signals with their associated links (connectors or interfaces). The fiber optic communication link 132 and fiber optic trigger link 134 is shown between the low voltage side controller 120 and the high voltage side controller 160. In an example, fiber optic communication link 136 (including a low voltage side or control fiber optic communication link [connector or interface] 126 and high voltage side fiber optic communication link [connector or interface] 156) may couple the user interface 114 to the high voltage controller 160. In an example, the communication link 132 between controllers 120 and 160 may be transmitted on a relatively "slow" bus used to transmit slower data from the user (e.g., heater setting, system status, and cathode voltage setting) that does not need to be adjusted at the pulse rate. The communication link 136 between the user interface 114 and the controller 160 can use a "fast" bus that is configured to set the parameters that can be adjusted on a pulse to pulse basis (e.g., grid pulse amplitude, width, and delay). The bus protocol may operate so a new message from the user on communication link 136 can be received and/or processed by the controller 160 prior to every pulse. In an example, the communication links 132 and 136 and trigger link 134 may use a synchronous or an asynchronous communication protocol. For example, the communication link 132 may use a universal asynchronous receiver-transmitter (UART) and the communication link 136 may use a flexible communication bus such as a controller area network (CAN) bus, transmission control protocol/Internet protocol (TCP/IP) bus, inter-integrated circuit (I2C) bus, serial peripheral interface (SPI) bus, or any other suitable communication bus. CAN bus is a robust bus standard originally designed for vehicles to allow microcontrollers and devices to communicate with each other in applications without a host computer. CAN bus can provide reliable communication on noisy communication channels (e.g., physical layer), which noisy communication can occur in imaging systems, including linacs. CAN bus signaling may also occur between the user interface 114 and the low voltage controller 120. Although a fiber optic communication link, connectors, and interfaces have been used as examples, other types isolating communication links whether optical and non-optical communication may be used.

The high voltage side 140 includes one or more high voltage side power supplies 142 and other high voltage side components, such as a high voltage controller 160, high-speed digital to analog converters (DAC) 162, 164, and 166, amplifiers 172, 174, and 176, gate drivers 180, and switches 182 and 184, and analog to digital converters (ADC) 158.

The high voltage side 140 components can be separately located, such as included on at least two printed circuit boards (PCBs). One PCB can include a power supply board with the one or more high voltage side power supplies 142, which can use a low voltage output (e.g., 24V) from the isolation power supply 130 to generate some of the voltages used on a second board, a high voltage side board, driver board, or driver module 150. More specifically, the one or more high voltage side power supplies 142 on the power supply board takes the low voltage output from the isolation power supply 130 as an input and generates the voltage rails for the drive voltage amplifier 172 (e.g., ~+200V and ~−15V), the cutoff voltage amplifier 174 (e.g., ~+24V and ~−200V), and the heater driver 176. A power supply rail or voltage rail refers to a single voltage provided by a power supply. In another example, the drive voltage has a range from 0 to 120V and the cutoff voltage has a range from 0 to −120V. In an example, one or more high voltage side power supplies 142 are integrated with the driver module 150 in a single PCB, referred to as a driver board 150. One of driver board's functions is to generate the filament voltage for the heater 194 and the grid cutoff and grid drive voltages for the grid 192. In some embodiments, these functions maybe some of the primary functions of the driver board 150. The driver board 150 takes the CCPS output 146 (e.g., −12 kV to −15 kV) and uses this voltage as its 'ground' or reference voltage, while also passing the reference voltage to the cathode 196 of the electron gun 190. As stated previously, the anode 198 is referenced to chassis ground, or the body of the linear accelerator to which the gun is mounted, which acts as a ground connection. The method by which the grid drive 168 and grid cutoff voltages 170 are generated is by using two high voltage power amplifiers (one amplifier for the drive 172 [or drive amplifier] and one amplifier for the cutoff 174 [or cutoff amplifier]) to generate the upper and lower voltage rails for a half bridge driver circuit. These amplifiers 172 and 174 are configured to generate square waves at a frequency of at least 1 kHz, and can change at the desired pulse rate of the gun driver. In an example, the high voltage amplifiers can provide limitations for speed and dynamic voltage range of the gun drivers, which can have a supply voltage range of up to 400V (+/−200V rails) with a slew rate of 50V/microsecond (μS) with a gain of 100. Between pulses, the user can send a message (e.g., serial message) to the gun driver, requesting the desired pulse amplitude, width and delay for the next pulse, as well as changes to the cutoff voltage at a rate of up to the desired pulse rate. The control board 110 will then relay the needed information to the driver board 150. The FPGA 160 on the driver board 150 can then set the output of a high-speed digital to analog converter (DAC) 162 and 164 that drives the half bridge amplifiers in preparation for the next pulse. When the front edge of the trigger is received from the user, the appropriate delay is applied (as previously requested by the user), and the appropriate signals are applied by the gate drivers 180 to the gates of the switches (e.g., drive switch 182 and cutoff switch 184) in the half bridge to generate the pulse whose width was previously requested by the user. The gun driver can also have a feed through mode in which the output pulse will simply follow the rising and falling edges of the input trigger signal 134. The drive switch 182 and cutoff switch 184 can include a high voltage n-channel enhancement-mode field-effect transistor (FET) or metal-oxide-semiconductor FET (MOSFET), insulated-gate bipolar transistor (IGBT), or similar high-power transistor. The heater amplifier 176 may be similar to the drive amplifier 172 or the cutoff amplifier 174 or may have a slower response time. For example, the heater amplifier may be driven by a DC input. The heater DAC 166 may be similar to the drive DAC 162 or the cutoff DAC 164 or may have a slower response time, a lower dynamic range, and/or lower resolution. The filament voltage 178 and cathode voltage 146 will also be programmable by the user, though these voltages may not respond at the same high-speed rate as the grid voltages.

Figure 3:
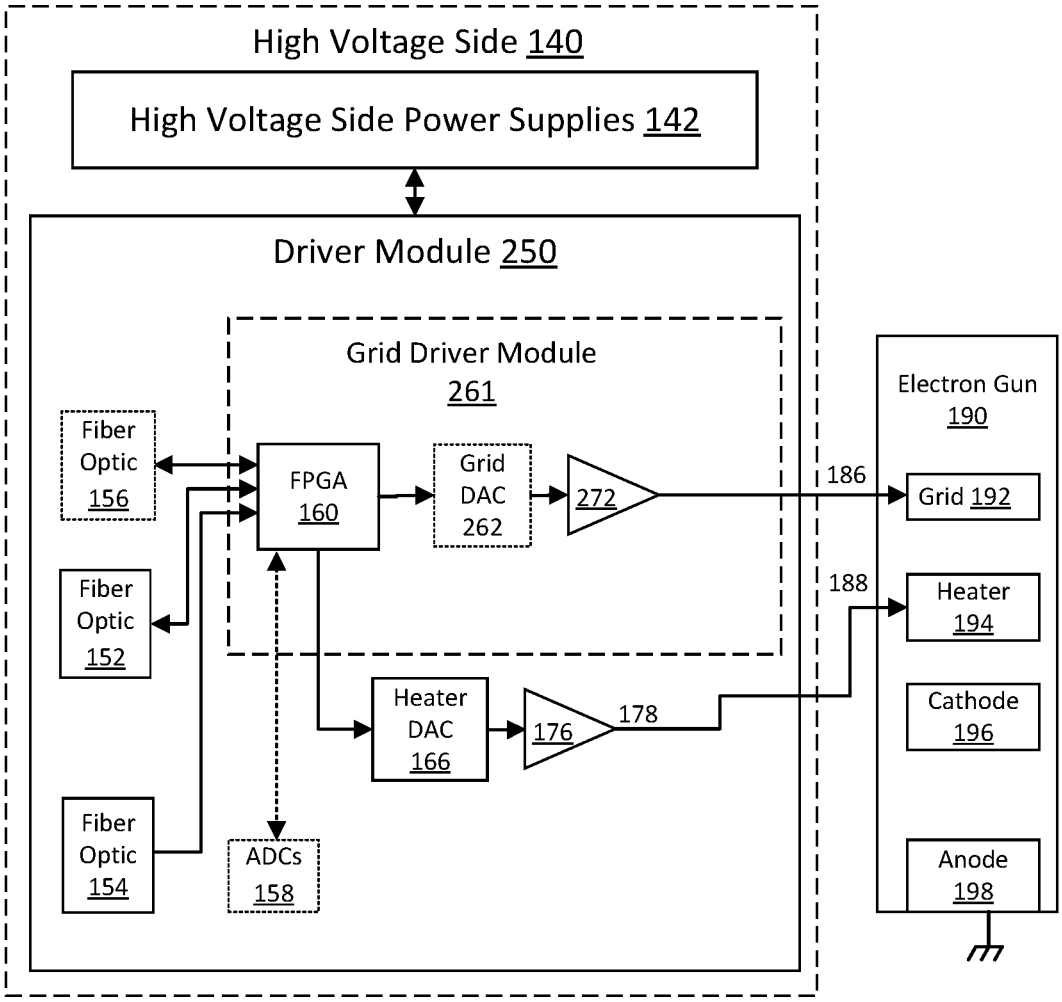
FIG. 3 illustrates a schematic or block diagram of an alternate driver module of a triode gun driver according to some embodiments.

FIG. 3 illustrates a schematic or block diagram of an alternate driver module 250 of a triode gun driver similar to the triode gun driver 110 shown in FIG. 1, where the grid driver module 161 is replace with a grid driver module 261. The grid driver module 261 can include a drive controller 160, a grid DAC 262, and a grid voltage amplifier 272, which can be coupled to a grid connection 186 of the grid 192. The grid voltage amplifier 272 can be powered by both the drive amplifier power supply 143 and the cutoff amplifier power supply 145 (or a power supply that provides both a negative and positive high voltage for the grid voltage amplifier 272). The input for the grid voltage amplifier 272 can be configured by a grid DAC 262. The drive controller 160 can apply parameters from the user interface 114 to adjust the pulse amplitude pulse by pulse by inputs to the grid DAC 262 and adjust the pulse width and delay via the response time of the grid voltage amplifier 272. The dynamic range of the grid voltage amplifier 272 may limit the pulse amplitudes or the pulse widths achieve by the grid voltage amplifier 272, as the grid voltage amplifier 272 is required to swing from a large negative cutoff voltage (e.g., <−50V) to large positive drive voltage (e.g., >50V). Relative to the half bridge configuration grid driver module 161 shown in FIG. 1, the swing of the output voltage of the grid voltage amplifier 272 may be approximately twice the voltage swing from either the drive amplifier 172 or the cutoff amplifier 174, which may result in longer pulse widths (e.g., greater than 0.5 μs), longer pulse edge rise and fall times (e.g., greater than 100 ns), greater pulse shape distortions (e.g., less like a rectangular pulse shape), or slower pulse rate capability of the gun driver (e.g., less than 500 pps).

Figure 4:
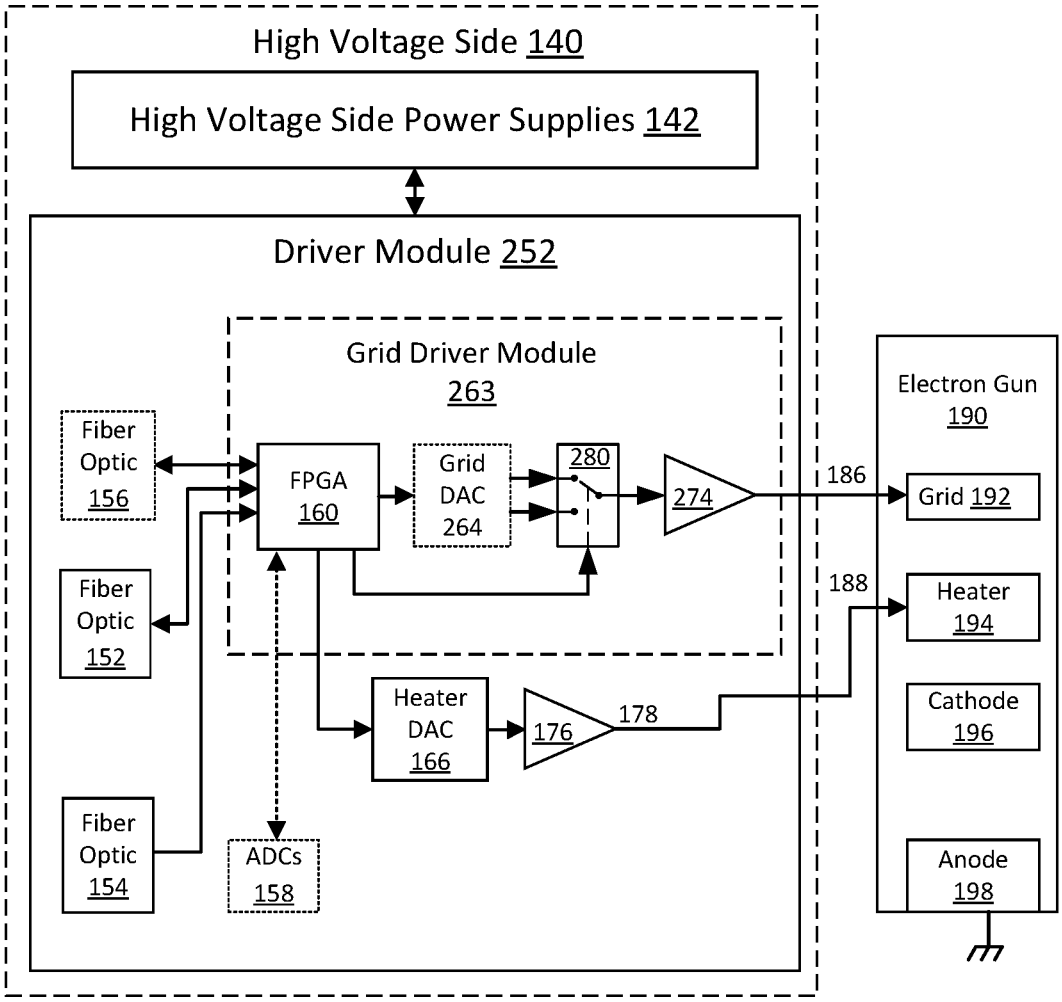
FIG. 4 illustrates a schematic or block diagram of an alternate driver module of a triode gun driver according to some embodiments.

FIG. 4 illustrates a schematic or block diagram of an alternate driver module 252 of a triode gun driver similar to the triode gun driver 110 shown in FIG. 1, where the grid driver module 161 is replace with a grid driver module 263. The grid driver module 262 can include a drive controller 160, a grid DAC 264, an analog switch 280, and a grid voltage amplifier 274, which can be coupled to a grid connection 186 of the grid 192. The grid voltage amplifier 274 can be powered by both the drive amplifier power supply 143 and the cutoff amplifier power supply 145 (or a power supply that provides both a negative and positive high voltage for the grid voltage amplifier 274). The input for the grid voltage amplifier 274 can be configured by a grid DAC 264 with at least two outputs to generate inputs to the grid voltage amplifier 274 (via the analog switch 280) to generate the grid drive voltage (e.g., an upper high voltage) and the grid cutoff voltage (e.g., a lower high voltage). The drive controller 160 can apply parameters or trigger signals from the user interface 114 to adjust the pulse amplitude pulse by pulse by inputs to the grid DAC 264 and adjust the pulse width and delay via the analog switch 280. The dynamic range of the grid voltage amplifier 274 may limit the pulse amplitudes or the pulse widths achieve by the grid voltage amplifier 274, as the grid voltage amplifier 274 is required to swing from a large negative cutoff voltage (e.g., <−50V) to large positive drive voltage (e.g., >50V). Relative to the half bridge configuration grid driver module 161 shown in FIG. 1, the swing of the output voltage of the grid voltage amplifier 274 may be approximately twice the voltage swing from either the drive amplifier 172 or the cutoff amplifier 174, which may result in longer pulse widths (e.g., greater than ≥−0.5 ns), longer pulse edge rise and fall times (e.g., greater than 100 ns), greater pulse shape distortions (e.g., less like a rectangular pulse shape), or slower pulse rate capability of the gun driver (e.g., less than 500 pps).

The disclosed grid driver circuitry, illustrated in FIGS. 1-4, provides high speed changes to pulse amplitude and timing over conventional gun drivers. The grid driver circuitry provides the user with the ability to select any drive voltage and cutoff voltage within its dynamic range on a pulse to pulse basis. One limitation on the number of modes available to the user within the dynamic range of the driver is the resolution of the DACs 162, 164, 262 that are driving the half bridge rail amplifiers 172, 174 or the grid voltage amplifier 272. A 10-bit DAC, for example, would offer a user 1024 drive voltages and 1024 cutoff voltages to choose from in the half bridge configuration grid driver module 161. A 10-bit DAC, for example, would offer a user 1024 grid voltages to choose from in the grid amplifier configuration grid driver module 261. A drive voltage dynamic range, for example, of 0V to 120V with a 10-bit DAC would offer the user a grid drive resolution of 117 mV. In an embodiment using a different DAC, the gun driver circuitry may be able to switch in the range of 1024 and 16384 different voltage levels.

Disclosed embodiments of the gun driver provide these functions for useful operation of an electron gun. In an example, the cathode voltage, heater voltage, grid drive voltage, grid cutoff voltage, grid pulse delay, and grid pulse width are each adjustable, with the grid drive voltage, grid cutoff voltage, grid pulse delay, and grid pulse width each being programmable at a rate of at least 500 Hertz (Hz) for adjustment on a pulse to pulse basis. In some examples, the grid drive voltage, grid cutoff voltage, grid pulse delay, and grid pulse width each being programmable at a rate of at least 1000 Hz or 2000 Hz for adjustment on a pulse to pulse basis.

In an example, the pulses of the electron gun (typically in the kilovolt range) are amplified by the linac to generate pulses with energies of 0.5 MeV to 10 MeV.

Figure 5:
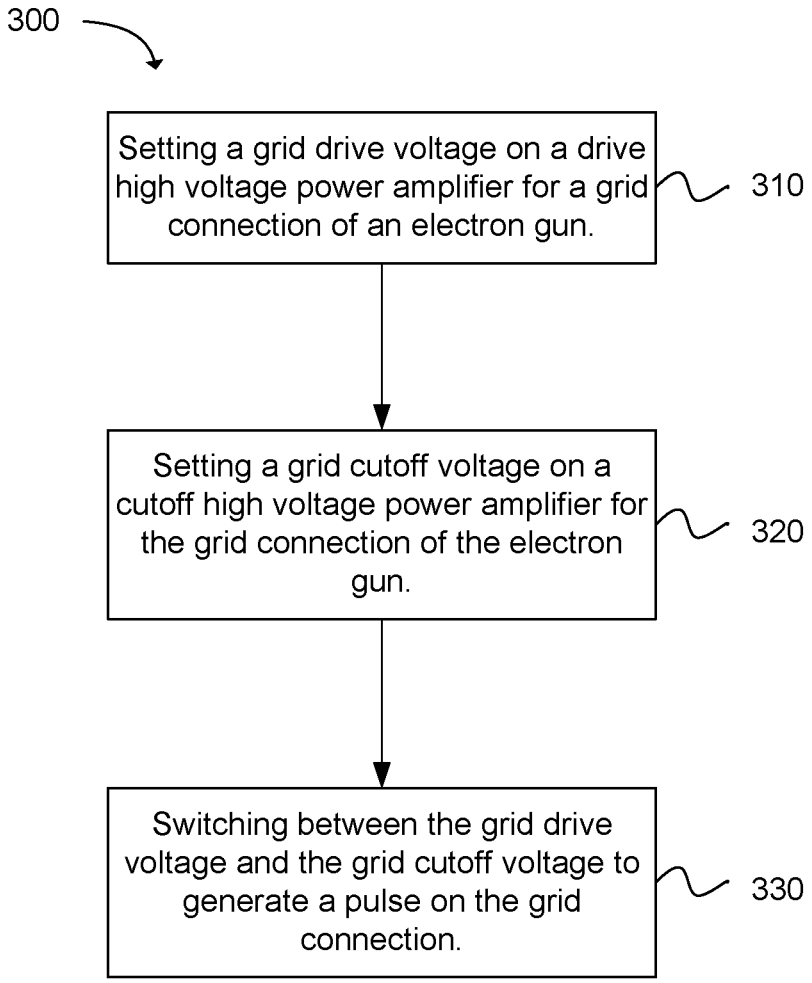
FIG. 5 is a flowchart illustrating an example of a method of controlling a triode gun driver according to some embodiments.

FIG. 5 illustrates a flowchart of a method 300 for controlling an electron gun driver according to some embodiments. Using the electron gun driver 110 of FIG. 1 as an example, in 310, the drive controller 160 and the drive DAC 162 set a grid drive voltage on the drive high voltage power amplifier 172 for the grid connection 186 of the electron gun 190. In 320, the drive controller 160 and the cutoff DAC 164 set a cutoff voltage on the cutoff high voltage power amplifier 174 for the grid connection 186 of the electron gun 190. In 320, the drive controller 160, the drive power switch 182, the cutoff power switch 184, and the gate driver 180 provide the switching between the grid drive voltage and the grid cutoff voltage to generate a pulse on the grid connection 186.

Some embodiments include an electron gun driver, comprising: a half bridge driver circuit, comprising: a drive circuit configured to generate a grid drive voltage (e.g., an upper high voltage) 168 for a grid connection 186 of an electron gun 190, and a cutoff circuit configured to generate a grid cutoff voltage (e.g., a lower high voltage) 170 for the grid connection 186 of the electron gun 190, and a gate driver 180 configured to switch between the grid drive voltage 168 and the grid cutoff voltage 170; and a drive controller 160 configured to generate a pulse input to the drive circuit and cutoff circuit and grid switching signals for the gate driver 180.

In some embodiments, the drive circuit further comprises: a drive high voltage power amplifier 172 configured to provide the grid drive voltage (e.g., an upper voltage) for the half bridge driver circuit, a drive high-speed DAC 162 configured to generate a programming voltage to the drive high voltage power amplifier 172, and a drive power switch 182 configured to apply the drive voltage to the grid connection 186. The cutoff circuit further comprises: a cutoff high voltage power amplifier 174 configured to provide the grid cutoff voltage (e.g., a lower voltage) to the half bridge driver circuit, a cutoff high-speed DAC 164 configured to generate a programming voltage to the cutoff high voltage power amplifier, and a cutoff power switch 184 configured to apply the cutoff pulse to the grid connection 186. The gate driver 180 is configured to apply grid control signals to the drive power switch 182 and the cutoff power switch 184.

In some embodiments, the electron gun driver further comprises: a heater circuit configured to generate a heater voltage 178 for the heater connection 188 of the electron gun 190, the heater circuit comprising: a heater power amplifier 176 configured to provide the heater voltage 178 to the heater connection 188 of the electron gun 190, a heater high-speed DAC 166 configured to generate a pulse to the heater power amplifier 176; and wherein the drive controller 160 is configured to generate a heater input to the heater circuit.

In some embodiments, the electron gun driver further comprises: a control circuit 110 configured to convert user inputs to driver controller inputs, the control circuit comprising: a user interface 114 configured to receive linear accelerator control system inputs; a low voltage side controller 120 configured to generate drive control signals for the drive controller 160; and a capacitor charging power supply (CCPS) controller 118 configured to generate CCPS control signals for a CCPS 144. In some embodiments, the drive control signals include a fiber optic communication link 132, 136 and a fiber optic trigger link 134. In some embodiments, the electron gun driver further comprises: an isolation power supply 130 configured to provide voltage isolation between the control circuit 110 and the half bridge driver circuit.

In some embodiments, the drive controller 160 is configured to adjust an amplitude, a width, and a delay of each pulse generated by the grid drive voltage and the grid cutoff voltage, wherein each pulse can be configured to be different from a prior pulse.

In some embodiments, at least one of an amplitude, a width, or a delay of each pulse generated by the grid drive voltage and the grid cutoff voltage are configured to be changed between pulses.

In some embodiments, at least one of an amplitude, a width, or a delay of each pulse generated by the grid drive voltage and the grid cutoff voltage are configured to be changed at a rate of at least 500 pulses per second.

Some embodiments include a system, comprising: the electron gun driver including a driver module 150; a high voltage capacitor 106; a capacitor charging power supply (CCPS) 144 configured to charge the high voltage capacitor; one or more high voltage side power supplies 142 configured to generate power for the high voltage side 140 of the electron gun driver; and an electron gun 190, comprising: an anode 198 coupled to ground 108, a cathode 196 coupled to an output 146 of the CCPS, a grid 192 coupled to the grid connection 186, and a heater 194.

Some embodiments use a method for controlling a gun driver, where the method comprises: setting a grid drive voltage on a drive high voltage power amplifier 172 for a the grid connection 186 of an electron gun 190; setting a grid cutoff voltage on a cutoff high voltage power amplifier 174 for the grid connection 186 of the electron gun 190; and switching between the grid drive voltage and the grid cutoff voltage pulse to generate a pulse on the grid connection 186.

In some embodiments, the method further comprises adjusting an amplitude, a width, or a delay of each pulse generated by the grid drive voltage or grid cutoff voltage, wherein at least three different amplitudes, at least three different widths, and at least three different delays can be used.

In some embodiments, the method further comprises altering at least one of an amplitude, a width, or a delay of the grid drive voltage pulse and the grid cutoff voltage pulse between pulses at a rate of at least 500 pulses per second.

In some embodiments, at least one non-transitory machine-readable storage medium comprising a plurality of instructions are adapted to be executed to implement the method above.

Some embodiments include an electron gun driver, comprising: a grid voltage generation means for generating a grid drive voltage (e.g., an upper high voltage) and a grid cutoff voltage (e.g., a lower high voltage) for a grid connection of an electron gun; a switching means for generating a pulse on the grid connection by switching between the grid drive voltage and the grid cutoff voltage; and a voltage controlling means for generating inputs to the grid voltage generation means and the switching means. Examples of grid voltage generation means include the drive high voltage power amplifier 172, the cutoff high voltage power amplifier 174, the grid voltage amplifier 272, the grid voltage amplifier 274, the drive amplifier power supply 143, and the cutoff amplifier power supply 145. Examples of switching means include the gate driver 180, the drive power switch 182, the cutoff power switch 184, the drive controller 160, and the analog switch 280. Examples of voltage controlling means include the drive controller 160.

In some embodiments, the electron gun driver further comprises a conversion means for converting the inputs to the grid voltage generation means to an analog input from a digital output of the voltage controlling means. Examples of conversion means include the drive high-speed DAC 162, the cutoff high-speed DAC 164, the grid DAC 262, and the grid DAC 264.

In some embodiments, the electron gun driver further comprises a command controlling means for converting user inputs to inputs for the voltage controlling means. Examples of command controlling means include the user interface 114 and the low voltage side controller 120.

In some embodiments, the electron gun driver is configured to adjust an amplitude, a width, and a delay of each pulse generated by the voltage controlling means, grid voltage generation means, and the switching means, wherein each pulse can be configured to be different from a prior pulse, and each of the amplitude, the width, and the delay can be altered between at least three different values.

In some embodiments, the electron gun driver is configured to change at least one of an amplitude, a width, and a delay of each pulse between pulses at a rate of at least 500 pulses per second.

The summary provided above is illustrative and is not intended to be in any way limiting. In addition to the examples described above, further aspects, features, and advantages of the invention will be made apparent by reference to the drawings, the following detailed description, and the appended claims.

Circuitry can include hardware, firmware, program code, executable code, computer instructions, and/or software. A non-transitory computer readable storage medium can be a computer readable storage medium that does not include a signal.

It should be understood that many of the functional units described in this specification have been labeled as modules, in order to more particularly emphasize their implementation independence. For example, a module may be implemented as a hardware circuit comprising custom very-large-scale integration (VLSI) circuits or gate arrays, including but not limited to logic chips, transistors, or other components. A module may also be implemented in programmable hardware devices, including but not limited to field programmable gate arrays (FPGA), programmable array logic, programmable logic devices or similar devices.

Reference throughout this specification to an "example" or an "embodiment" means that a particular feature, structure, or characteristic described in connection with the example is included in at least one embodiment of the invention. Thus, appearances of the words an "example" or an "embodiment" in various places throughout this specification are not necessarily all referring to the same embodiment.

Furthermore, the described features, structures, or characteristics may be combined in a suitable manner in one or more embodiments. In the following description, numerous specific details are provided (e.g., examples of layouts and designs) to provide a thorough understanding of embodiments of the invention. One skilled in the relevant art will recognize, however, that the invention can be practiced without one or more of the specific details, or with other methods, components, layouts, etc. In other instances, well-known structures, components, or operations are not shown or described in detail to avoid obscuring aspects of the invention.

The claims following this written disclosure are hereby expressly incorporated into the present written disclosure, with each claim standing on its own as a separate embodiment. This disclosure includes all permutations of the independent claims with their dependent claims. Moreover, additional embodiments capable of derivation from the independent and dependent claims that follow are also expressly incorporated into the present written description. These additional embodiments are determined by replacing the dependency of a given dependent claim with the phrase "any of the claims beginning with claim [x] and ending with the claim that immediately precedes this one," where the bracketed term "[x]" is replaced with the number of the most recently recited independent claim. For example, for the first claim set that begins with independent claim 1, claim 4 can depend from either of claims 1 and 3, with these separate dependencies yielding two distinct embodiments; claim 5 can depend from any one of claim 1, 3, or 4, with these separate dependencies yielding three distinct embodiments; claim 6 can depend from any one of claim 1, 3, 4, or 5, with these separate dependencies yielding four distinct embodiments; and so on.

Recitation in the claims of the term "first" with respect to a feature or element does not necessarily imply the existence of a second or additional such feature or element. Elements specifically recited in means-plus-function format, if any, are intended to be construed to cover the corresponding structure, material, or acts described herein and equivalents thereof in accordance with 35 U.S.C. § 112(f). Embodiments of the invention in which an exclusive property or privilege is claimed are defined as follows.

What is claimed is:

1. An electron gun driver, comprising:

a half bridge driver circuit, comprising:

a drive circuit configured to generate a grid drive voltage for a grid connection of an electron gun, the drive circuit including:

a drive high voltage power amplifier configured to provide the grid drive voltage for the half bridge driver circuit, a drive high-speed digital to analog converter (DAC) configured to generate a programming voltage to the drive high voltage power amplifier, and a drive power switch configured to apply the grid drive voltage to the grid connection; and a cutoff circuit configured to generate a grid cutoff voltage for the grid connection of the electron gun; and a gate driver configured to switch between the grid drive voltage and the grid cutoff voltage; and a drive controller configured to generate a pulse input to the drive circuit and cutoff circuit and grid switching signals for the gate driver.

2. The electron gun driver of claim 1, wherein:

the cutoff circuit further comprises:

a cutoff high voltage power amplifier configured to provide the grid cutoff voltage for the half bridge driver circuit, a cutoff high-speed DAC configured to generate a programming voltage to the cutoff high voltage power amplifier, and a cutoff power switch configured to apply the cutoff voltage to the grid connection; and the gate driver is configured to apply grid control signals to the drive power switch and the cutoff power switch.

3. The electron gun driver of claim 1, further comprising:

a heater circuit configured to generate a heater voltage for the heater connection of the electron gun, the heater circuit comprising:

a heater power amplifier configured to provide the heater voltage to the heater connection of the electron gun, a heater high-speed DAC configured to generate a programming signal to the heater power amplifier; and wherein the drive controller is configured to generate a heater input to the heater circuit.

4. The electron gun driver of claim 1, further comprising:

a control circuit configured to convert user inputs to driver controller inputs, the control circuit comprising:

a user interface configured to receive linear accelerator control system inputs;

a low voltage side controller configured to generate drive control signals for the drive controller; and a capacitor charging power supply (CCPS) controller configured to generate CCPS control signals for a CCPS.

5. The electron gun driver of claim 4, wherein the drive control signals include a fiber optic communication link and a fiber optic trigger link.

6. The electron gun driver of claim 4, further comprising:

an isolation power supply configured to provide voltage isolation between the control circuit and the half bridge driver circuit.

7. The electron gun driver of claim 1, wherein the drive controller is configured to adjust an amplitude, a width, and a delay of each pulse generated by the grid drive voltage and the grid cutoff voltage, wherein each pulse can be configured to be different from a prior pulse.

8. The electron gun driver of claim 1, wherein at least one of an amplitude, a width, or a delay of each pulse generated by the grid drive voltage and the grid cutoff voltage are configured to be changed between pulses.

9. The electron gun driver of claim 1, wherein at least one of an amplitude, a width, or a delay of each pulse generated by the grid drive voltage and the grid cutoff voltage are configured to be changed at a rate of at least 500 pulses per second.

10. A system, comprising:

the electron gun driver of claim 1;

a high voltage capacitor;

a capacitor charging power supply (CCPS) configured to charge the high voltage capacitor;

one or more high voltage side power supplies configured to generate power for the high voltage side of the electron gun driver; and an electron gun, comprising:

an anode coupled to ground, a cathode coupled to an output of the CCPS, a grid coupled to the grid connection, and a heater.

11. A method for controlling an electron gun driver, the method comprising:

setting a grid drive voltage on a drive high voltage power amplifier for a grid connection of an electron gun, including:

generating a programming voltage with a drive high-speed digital to analog converter (DAC); and amplifying the programming voltage with the drive high voltage power amplifier configured to generate the grid drive voltage;

setting a grid cutoff voltage on a cutoff high voltage power amplifier for the grid connection of the electron gun; and switching between the grid drive voltage and the grid cutoff voltage to generate a pulse on the grid connection.

12. The method of claim 11, further comprising:

adjusting an amplitude, a width, or a delay of each pulse generated by the grid drive voltage or grid cutoff voltage, wherein at least three different amplitudes, at least three different widths, and at least three different delays can be used.

13. The method of claim 11, further comprising:

altering at least one of an amplitude, a width, or a delay of the pulse at a rate of at least 500 pulses per second, wherein each of the amplitude, the width, and the delay can be altered between at least three different values.

14. At least one non-transitory machine-readable storage medium comprising a plurality of instructions adapted to be executed to implement the method of claim 11.

15. An electron gun driver, comprising:

a grid voltage generation means for generating a grid drive voltage and a grid cutoff voltage for a grid connection of an electron gun;

a switching means for generating a pulse on the grid connection by switching between the grid drive voltage and the grid cutoff voltage; and a voltage controlling means for generating inputs to the grid voltage generation means and the switching means wherein the grid voltage generation means includes:

a conversion means for converting the inputs to the grid voltage generation means to an analog input from a digital output of the voltage controlling means; and amplifying means for generating the grid drive voltage in response to the analog input.

16. The electron gun driver of claim 15, further comprising:

a heater voltage means for generate a heater voltage for the heater connection of the electron gun; and wherein the voltage controlling means generates an input to the heater voltage means.

17. The electron gun driver of claim 15, further comprising:

a command controlling means for converting user inputs to inputs for the voltage controlling means.

18. The electron gun driver of claim 15, wherein the electron gun driver is configured to adjust an amplitude, a width, and a delay of each pulse generated by the voltage controlling means, grid voltage generation means, and the switching means, wherein each pulse can be configured to be different from a prior pulse, and each of the amplitude, the width, and the delay can be altered between at least three different values.

19. The electron gun driver of claim 15, wherein the electron gun driver is configured to change at least one of an amplitude, a width, and a delay of each pulse between pulses at a rate of at least 500 pulses per second.

* * * * *